US005598256A

United States Patent [19]

Kimura et al.

[11] Patent Number: 5,598,256

[45] Date of Patent: Jan. 28, 1997

[54] IMAGE FORMING APPARATUS

[75] Inventors: Yoichi Kimura, Kawaguchi; Isao Kumada, Yamato; Takashi Hasegawa, Ageo; Satoshi Tamura, Yokohama, all of Japan

[73] Assignee: Canon Kabushiki Kaisha, Tokyo, Japan

[21] Appl. No.: 371,143

[22] Filed: Jan. 11, 1995

[30] Foreign Application Priority Data

Jan. 11, 1994 [JP] Japan ..... 6-013211

[51] Int. Cl.[6] ..... G03G 15/16

[52] U.S. Cl. ..... 399/316; 399/66

[58] Field of Search ..... 355/273, 274, 355/326 R

[56] References Cited

U.S. PATENT DOCUMENTS

| | | | |
|---|---|---|---|
| 3,970,381 | 7/1976 | Meagher et al. | 355/315 |
| 4,190,348 | 2/1980 | Friday | 355/274 |
| 5,083,167 | 1/1992 | Fukushima et al. | 355/274 |
| 5,172,172 | 12/1992 | Amemiya et al. | 355/271 |
| 5,200,784 | 4/1993 | Kimura et al. | 355/274 |
| 5,438,399 | 8/1995 | Asai | 355/273 |
| 5,450,180 | 9/1995 | Ohzeki et al. | 355/274 |

*Primary Examiner*—Nestor R. Ramirez

*Attorney, Agent, or Firm*—Fitzpatrick, Cella, Harper & Scinto

[57] ABSTRACT

An image forming apparatus includes an image bearing member for bearing an image, a transfer charging device for transferring the image from the image bearing member onto a recording material at a transfer position, a power source for supplying a voltage to the transfer charging device during an image transfer operation, and a control device for changing an output of the transfer charging device from a first level to a second level prior to arrival of an image area of the image bearing member at the transfer position, wherein the second level is higher than a third level of the output which is a level when the image area is at the transfer position.

35 Claims, 6 Drawing Sheets

IMAGE FORMING APPARATUS

FIELD OF THE INVENTION AND RELATED ART

The present invention relates to an image forming apparatus such as a copying machine or a laser beam printer,for example, of an electrophotographic type or an electrostatic recording type, and more particularly, to the image forming apparatus for producing an output image by transferring, onto the recording material, an image formed on an image bearing member.

Heretofore, in an image forming apparatus using the electrophotographic type, or the electrostatic recording type as shown in FIG. 7, a recording material 200 is attracted and Carried on a recording material carrying member 100 moving along an endless path, and an image 300 is formed on the recording material 200, and the transfer electric field is weakened in a non-image area at the leading end of a recording material 200, and in the image area a sufficient transfer electric field is provided by the proper control, so that the recording material 200 is carried in a stable attraction sate.

This is because of the reduction of the attraction force supplied to the recording material by the attraction charging means generated by the transfer electric field, for example. Particularly, when the electrostatic attraction force at the end portion is reduced, the recording material tends to be easily peeled, and therefore, it is technically important for further stable carrying, particularly for carrying thick paper or the like.

On the other hand, in the case where the transfer current is changed at the non-image area of the recording material ($\delta t$) the rise time is required until a sufficient transfer electric field is supplied.

In the case where the responsivity of the transfer high voltage source is the same, the $\delta t$ increases under the low humidity condition where the impedance of the recording material is high. In addition, in a system executing a superimposing transfer operation as in a full-color copying machine, for example, the charge is accumulated by superimposing transfer and also, the high impedance of the recording material the $\delta t$ increases.

For example, in the four color superimposing transfer system as shown in a graph of FIG. 8, the $\delta t$ increases for each color ($\delta t1$–$\delta t4$), and in some cases with the rise time $\delta t4$ for the fourth color 4 it exceeds the blank portion width required for the recording material (the recording material non-image area).

As a result, for the fourth color, an image defect wherein the density is decreased at the end of the image leading portion results.

SUMMARY OF THE INVENTION

The principal object of the present invention is to provide an image forming apparatus wherein the rise time of the transfer electric field is minimized.

Another object of the present invention is to provide an image forming apparatus wherein reduction of the image density adjacent to the leading end of the recording material is prevented.

A further object of the present invention is to provide an image forming apparatus wherein the output upon operation start of the transfer charger is made larger than the output of the transfer charger when the image area is at the transfer position.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

An image forming apparatus according to the present invention will be described in detail in conjunction with the drawings.

Figure 1:
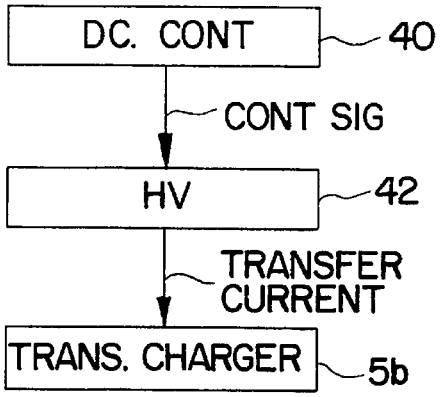
FIG. 1 is a block diagram showing an output control of a transfer charger.
Figure 2:
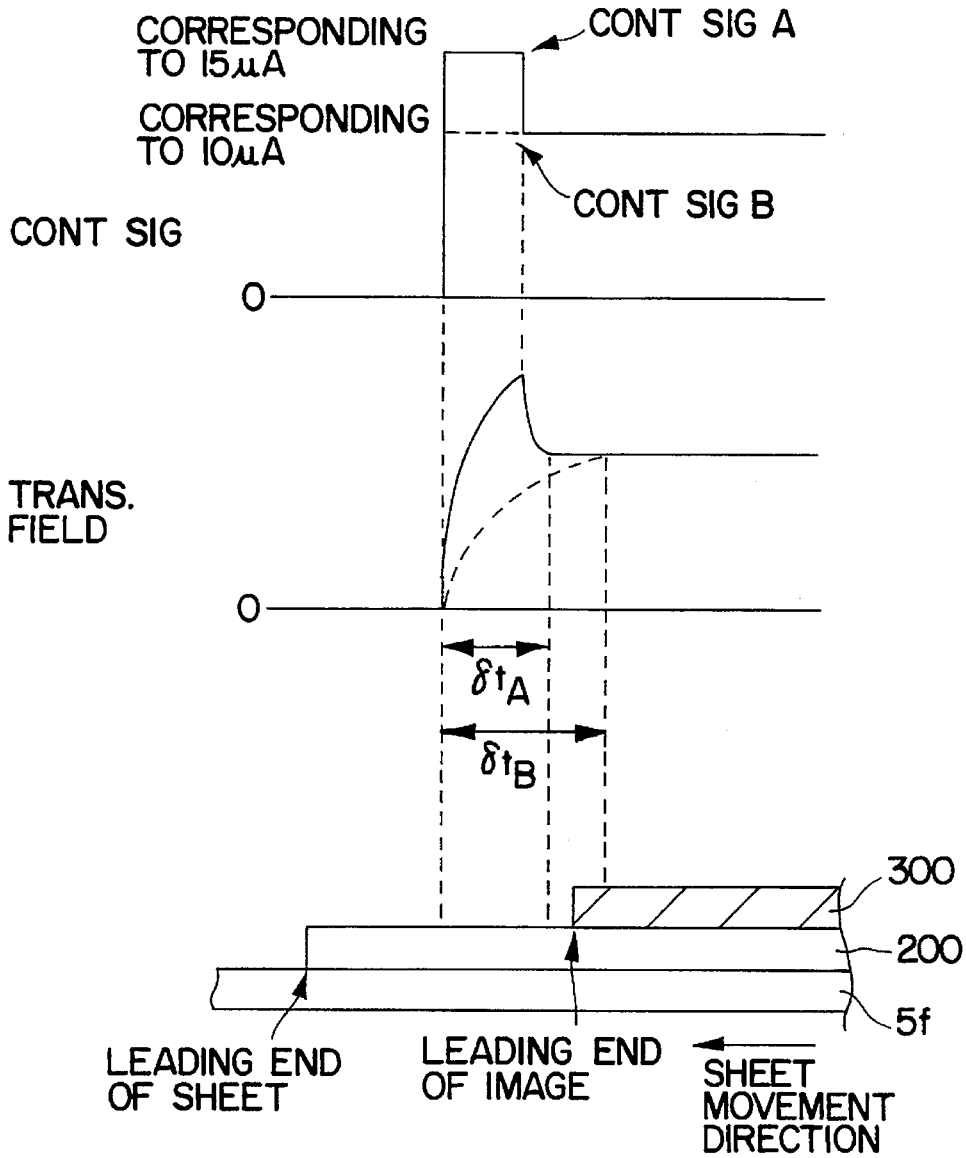
FIG. 2 is an illustration of a state of the rising of a transfer electric field according to a first embodiment of the present invention.
Figure 3:
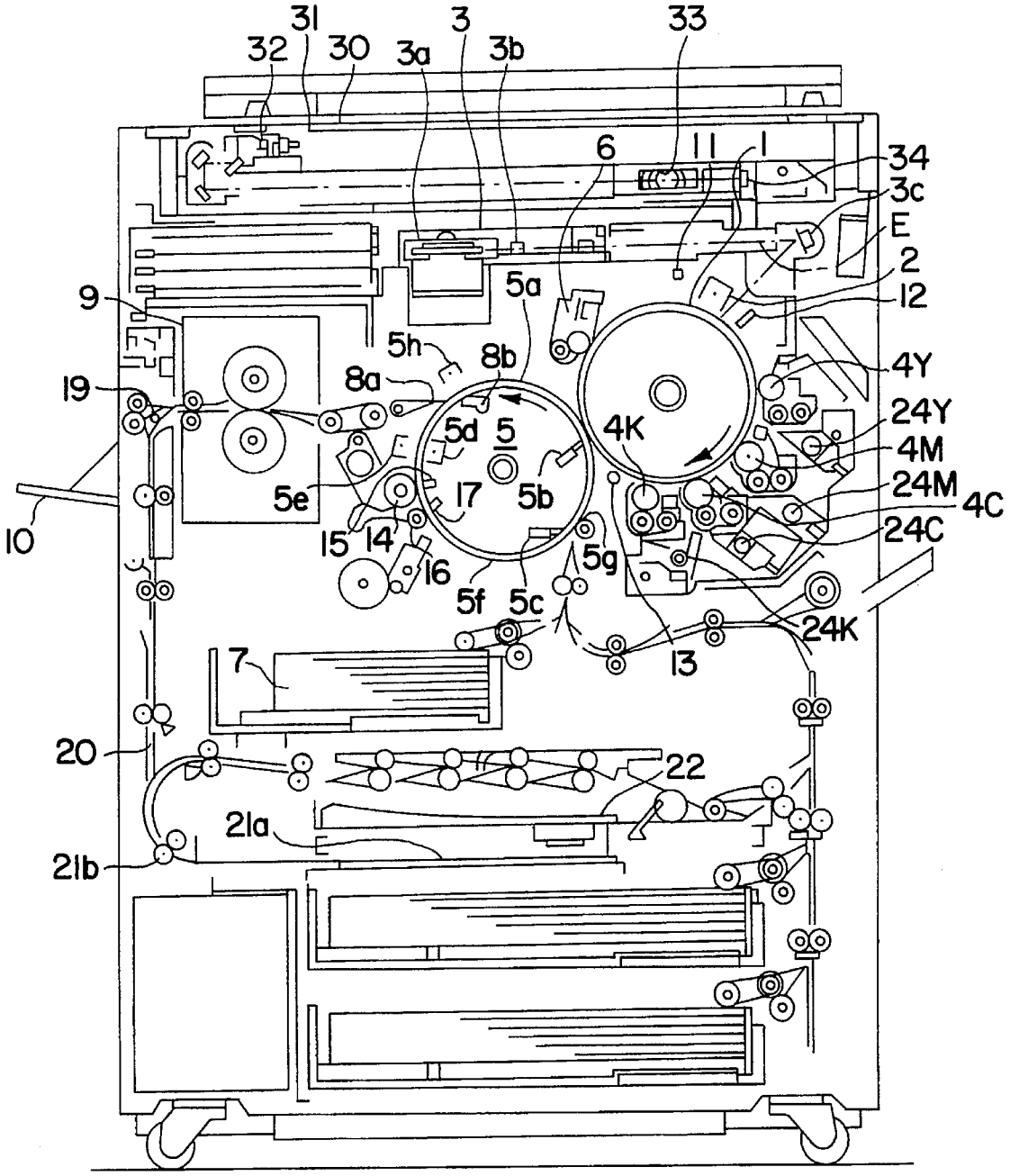
FIG. 3 is a general arrangement of a color image forming apparatus using the present invention.

Referring to FIGS. 1–3 the image forming apparatus according to the first embodiment of the present invention will be described.

Referring to FIG. 3 a general arrangement of the color image forming apparatus will be described.

In FIG. 3 the color image forming apparatus comprises a digital color image reader at the upper portion of it, and includes a digital color image printer portion at the lower portion of it.

In The reader portion, an original 30 is disposed on an original carriage glass 31, and a reflection light image from the original 30 provided by exposure scan of the exposure lamp 32, is focused on a full-color sensor 34 through a lens 3 so that a color separation image signal is provided.

The color separation image signal is amplified by an amplification circuit unknown, and thereafter it is processed by an video processing unit unshown, and is transmitted to the printer portion.

At the printer portion, a photosensitive drum 1 as the image bearing member is supported for rotation in the direction of an arrow.

Around the photosensitive drum 1 there are disposed a pro-exposure lamp 1 for initializing the photosensitive drum 1, a corona charger 2 for charging uniformly the photosensitive drum 1, an a laser exposure optical system 3 for forming the electrostatic latent image in accordance with image information on the photosensitive drum 1, a potential sensor 12 for detecting the potential of the surface of the photosensitive drum 1, a stationary developing device which develops into a visualized image the electrostatic latent image formed on the photosensitive drum 1 an which comprises developing device 4Y, 4M, 4C, 4BK for accommodating developers (toners) having different colors, light detection means 13 for detecting a toner quantity on the photosensitive drum 1, a transfer device 5 including a transfer drum 5*a* as a recording material carrying member, and a cleaner 6 for removing developer remaining on the photosensitive drum 1 or the like.

In the laser exposure optical system 3 the image signal from the reader portion is converted into a light signal at the laser output portion (not shown), and the laser light converted is reflected by the polygonal mirror 3*a* so that it is projected onto the surface of the photosensitive drum 1, through the lens 3*b* and the mirror 3*c*.

Upon image forming at the printer portion, the photosensitive drum 1 it is rotated in the direction of the arrow indicated, and by the pre-exposure lamp 1 the photosensitive drum 1 is discharged and initialized. Subsequently the photosensitive drum 1 is charged uniformly, by the charger 2, and the light image E corresponding to each color image signal color-separated by the image exposure means 3 is projected sequentially onto the surface of the photosensitive drum 1 so that the latent image is formed.

A predetermined one of the developing devices is operated, and a latent image on the photosensitive drum 1 is developed so that a toner image comprising, as a major component, a resin material is formed on the photosensitive drum 1.

The developing device is brought close to the photosensitive drum 1 selectively in response to each separated color, by operation of eccentricity cams 24Y, 24C, 24M and 24K, and carries out the developing operation.

In addition, the toner image on the photosensitive drum 1 is transferred to the recording material 200 supplied on the position opposed to the photosensitive drum 1 through the transportation system and the transfer device 5 from the recording material cassette 7.

The transfer device 5 includes in this example a transfer drum 5*a*, a transfer charger 5*b*, an attraction roller 5*g* opposed to an attraction charger 5*c* for electrostatic attractions of the recording material, an inside charger 5*d*, an outside charger 5*e*, and in a peripheral surface opening area of the transfer drum 5*a* supported for rotation a recording material carrying sheet 5FI comprising a dielectric member is stretched integrally into a cylindrical shape.

A dielectric member sheet such as a polycarbonate film as the recording material carrying sheet 5*f* is used.

In accordance with the rotation of the drum-like transfer device, namely, the transfer drum 5*a*, the toner image on the photosensitive drum is transferred onto a recording material carried on the recording material carrying sheet 5*f*, by the transfer charger 5*b*.

In this embodiment the transfer charger 5*b* is contactable to the back side of the carrying sheet 5*f*, and it is in the form of a brush.

The recording material 200 is attracted and transported on the recording material carrying sheet 5*f*. In this manner, the desired number of color images 300 are transferred so that a superimposed color image is formed.

In the case of full-color image forming, when transfer of the toner image of each color is completed in this manner, the recording material is separated from the transfer drum 5*a* by the functions of the separation claws 8*a*, the separation charger 5*h* and the pushing roller 8*b*, and the sheet is discharged to a tray 10 through the heat roller fixing device 9.

On the other hand, after the transfer operation, the remaining toner on the surface of the photosensitive drum 1 is removed by the cleaner 6, and the photosensitive is prepared for image forming process again.

In the case where an image is to be formed on both surfaces of the recording material, as soon as the recording material is discharged from the fixing device 9 the transportation path switching guide 19 is driven so as to introduce once the recording material to a reversing path 21*a* through the transportation vertical path 20.

Thereafter, by reverse rotation of the reversion roller 21*b* the recording material is fed back in the opposite direction relative to the fed direction with the trailing end of the recording material when it is fed, at the head, and it is accommodated in the intermediate tray 2.

Thereafter the recording material is transported to the transfer device 5 from the intermediate tray 2 again, and by the image forming process discribed above an image is formed on the other surface.

In order to prevent scattering and deposition of toner particles on the recording material carrying sheet 5*f* of the transfer drum 5*a*, the deposition of an oil on the recording material or like cleaning operation is executed by the function of a fur-brush 14 and a back-up brush 15 opposed to the fur-brush 14 through a recording material carrying sheet 5*f*, and an oil removing roller 16 and back-up brush 17 opposed to the removing roller 16 through the recording material carrying sheet 5*f*.

Such a cleaning is executed before and/or after the image forming operation, and upon the occurrence of a jam (sheet jam), it or is carried out as desired.

EMBODIMENT 1.

Referring to FIGS. 1 and 2, a first embodiment of the present invention will be described.

In this embodiment, the transfer charger 5*b* is controlled by a voltage source 42 so that a constant current is supplied, and the output control therefor is carried out in such a manner as indicated in a block diagram of FIG. 1.

More particularly, in accordance with the value of the control signal fed from the DC controller 40, the transfer current is supplied from the high voltage voltage source 42 so hat the output is supplied to the transfer charger 5*b*.

However, if the signal corresponding to the constant current 10 μA continues to be supplied to the high voltage voltage source 42 like the control signal B shown in FIG. 2 after the transfer charger is switched to the operation state from the non-operation state, the rise time δtB occurs in the actual transfer electric field due to the impedances of the transfer charger 5*b*, the recording material carrying sheet 5*f* and the recording material.

The δtB as is apparent in FIG. 2 exceeds the non-image area of the recording material 200 into the image area, and as a result an image defect occurs at the leading end of the recording material.

Here, the non-image area is the region in which the image is not formed on the recording material in response to an arbitrary image signal, and the image area is the region capable of image formation on the recording material in response to an arbitrary image signal.

The image area and the non-image area correspond to the non-image area and the image area of the photosensitive member, respectively.

In order to prevent the occurrence of such an image defect in this embodiment, after the transfer charger is switched to ON from OFF an upon the rising of the voltage source as indicated by a control signal A, in other words, upon the operation start of the transfer charges, a signal corresponding to 15 μA which, is larger than the desired current 10 μA is fed for 18 msec, and only thereafter, a signal corresponding to the desired constant current 10 μA is supplied.

As a result, the conventional rise time δtB=50 msec is reduced remarkably, and it is δtA=27 ms in this embodiment.

In the case of a process speed of 133 mm/sec in the present embodiment, a difference δδt between the δtA=23 msec and δtB0 (conventional rise time and that in the present embodiment), corresponds to an approx. 3.0 mm in the length of the recording material.

Here, the blank width at the leading end of the recording material is set to 8 mm.

The control of the transfer charger as described hereinbefore is common from the first color transfer up to the fourth color transfer.

By reducing the rise time δt of the transfer electric field in this manner, the recording material tends to be removed from the carrying sheet 5*f* when 15 μA flows in the transfer charger before the recording material leading edge reaches the transfer position, and therefore, it is preferable that 15 μA is caused to flow through the transfer charger after the recording material leading edge reaches the transfer position.

By the reduction of the rise time, the following advantageous effects are provided:

(1) at the leading end (a blank width of 8 mm) of the recording material, a region without application of the transfer electric field increases, and therefore, the carrying of the recording material is stabilized.

(2) an image defect due to density insufficiency at the end portion can be prevented.

(3) the transfer electric field is started is increased.

(4) the recording material carrying power and the positional latitude of the transfer electric field are sufficient, by which the possibility that the blank width of the recording material can be decreased is provided.

EMBODIMENT 2.

Figure 4:
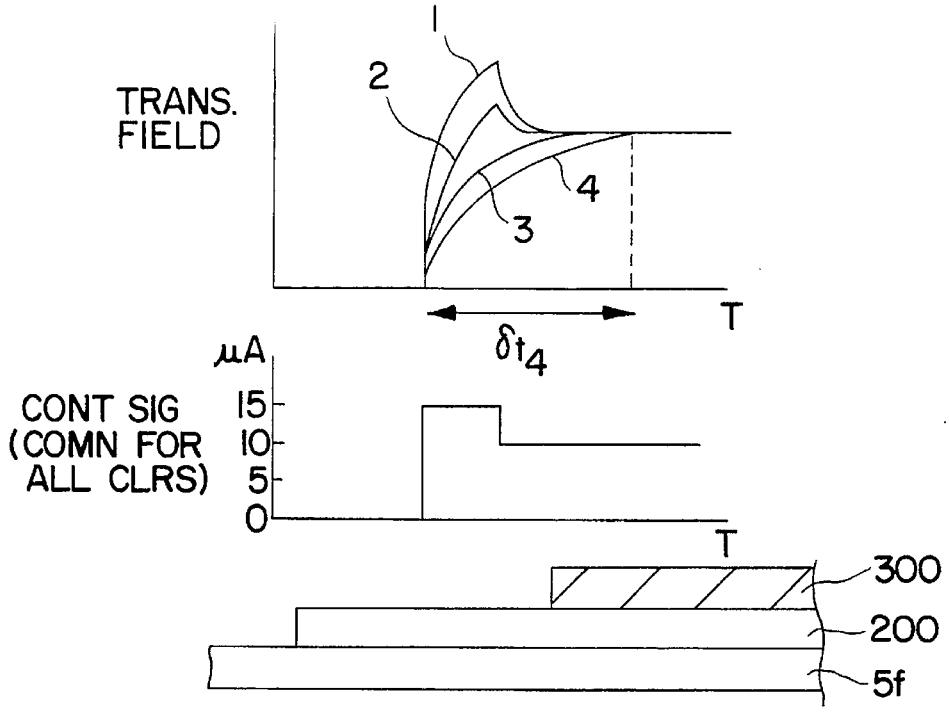
FIG. 4 is an illustration of the condition of the rising of the transfer electric field when the first embodiment is applied to a four color image forming operation.
Figure 5:
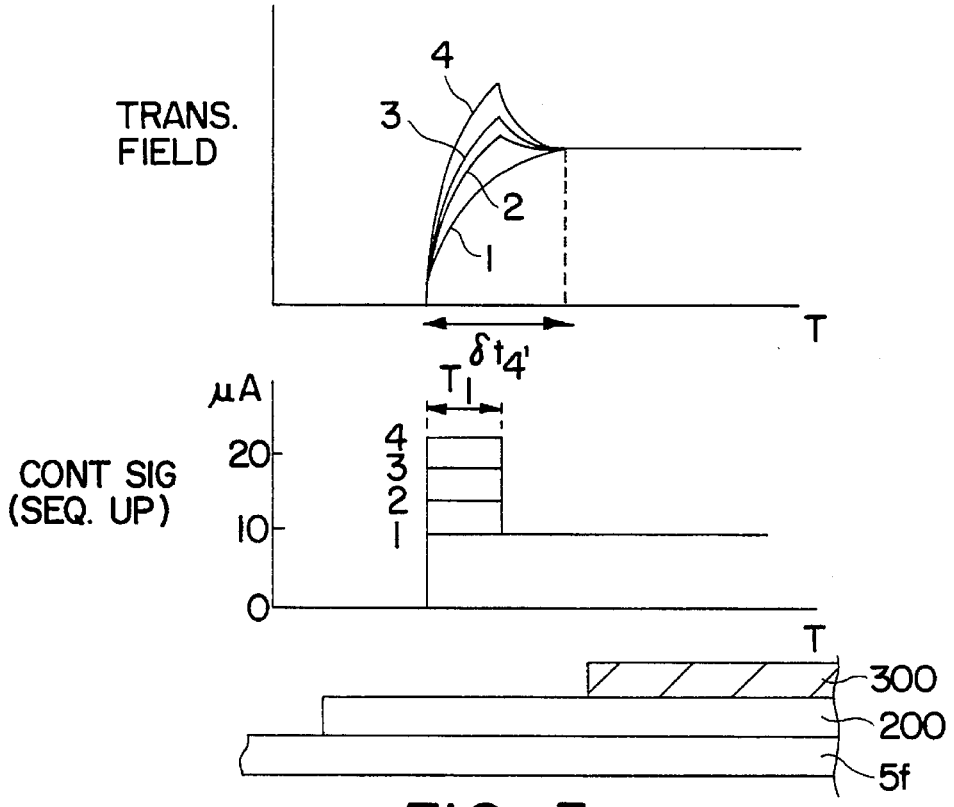
FIG. 5 is an illustration of the state of the rising of the transfer electric field in a second embodiment of the present invention.

Referring to FIGS. 4 and 5 a description will be made as to a second embodiment wherein the output of the transfer charger is controlled.

In the first embodiment, for each transfer the rise time δt of the transfer electric field is reduced, by which many advantageous effects can be provided, but in the case of the superimposing transfer system it is preferable that the delay, in total, of the transfer electric field is suppressed to the minimum in addition to each transfer.

For example, in the case of the 4 color image formation as shown in a graph of FIG. 4, charge is accumulated each time the transfer electric field is supplied by the 4 transfer operations, and therefore, the δt increases gradually.

In the case where the rising current Is increased by the control signal A as in the first embodiment, more charge is applied at the leading end portion, and therefore, as indicated in the graph of FIG. 4 the tendency becomes more strong and the δt4 for the final color becomes the value not different from the δtA of the final color by the control signal B.

In FIG. 4, numerals 1, 2, 3, 4, indicate the first, second, third and fourth color transfer operations, respectively, for the same transfer material.

In embodiment 1 (FIG. 4), the rise time control signal A is fixed to 18 msec and 15 μA for all the colors, but in embodiment 2, as shown in the graph of FIG. 5, for the first color, it is 10 μA; for the second color it is 14 μA; for the third color it is 18 μA; and for the fourth color it is 22 μA. That is, the rising current rises sequentially for each each color. As a result, the rise time δt4 of the final color is reduced to δt4f=42 msec from δt4=60 msec.

By this, an effect which is similar to the first embodiment can be provided also at the time of the superimposing transfer.

In addition, in this embodiment, the rising current increases for each color and the output time of T1 (FIG. 5) thereof is made the same, but in a possible alternative example that 10 μA is used for the first color, and 14 μA is used for the 2–4th color, so that the output time of the rising current only for the fourth color is longer than the other.

In other words the output time of T1 of the rising current may be changed for each color.

EMBODIMENT 3.

Figure 6:
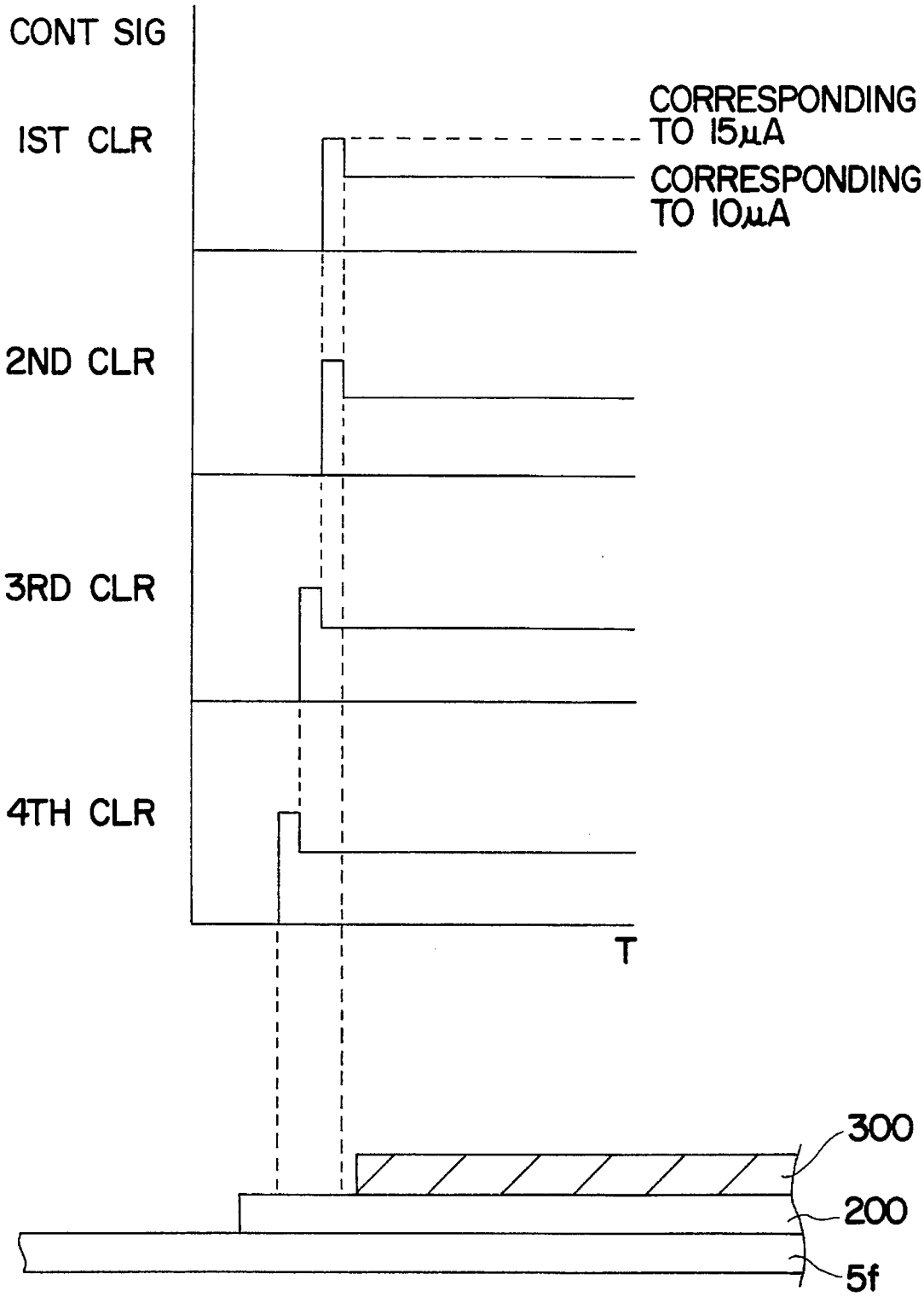
FIG. 6 is an illustration of the state of the rising of the transfer electric field in a third embodiment of the present invention.
Figure 7:
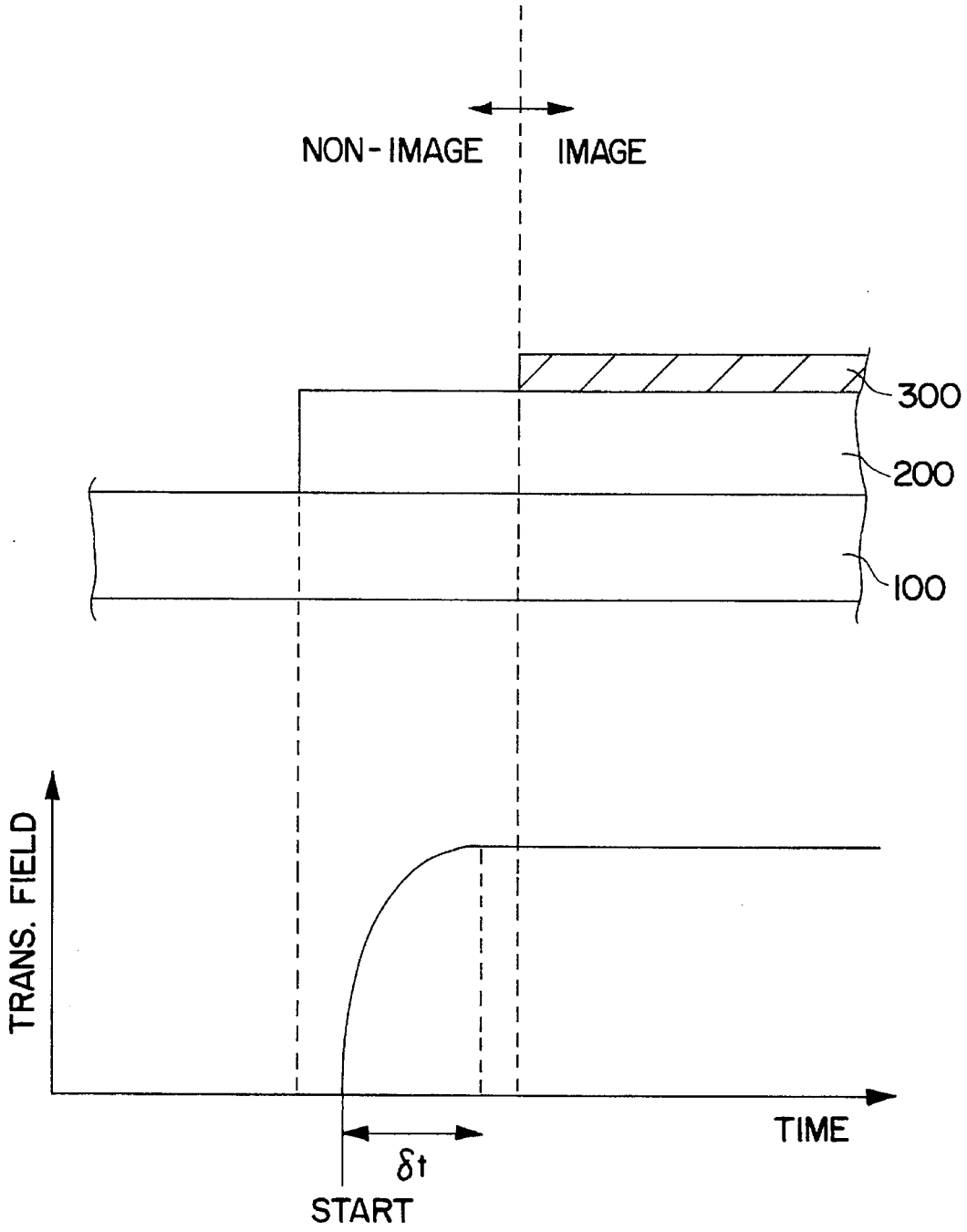
FIG. 7 PRIOR ART
FIG. 7 is an illustration of the conventional state of the rising of the transfer electric field.
Figure 8:
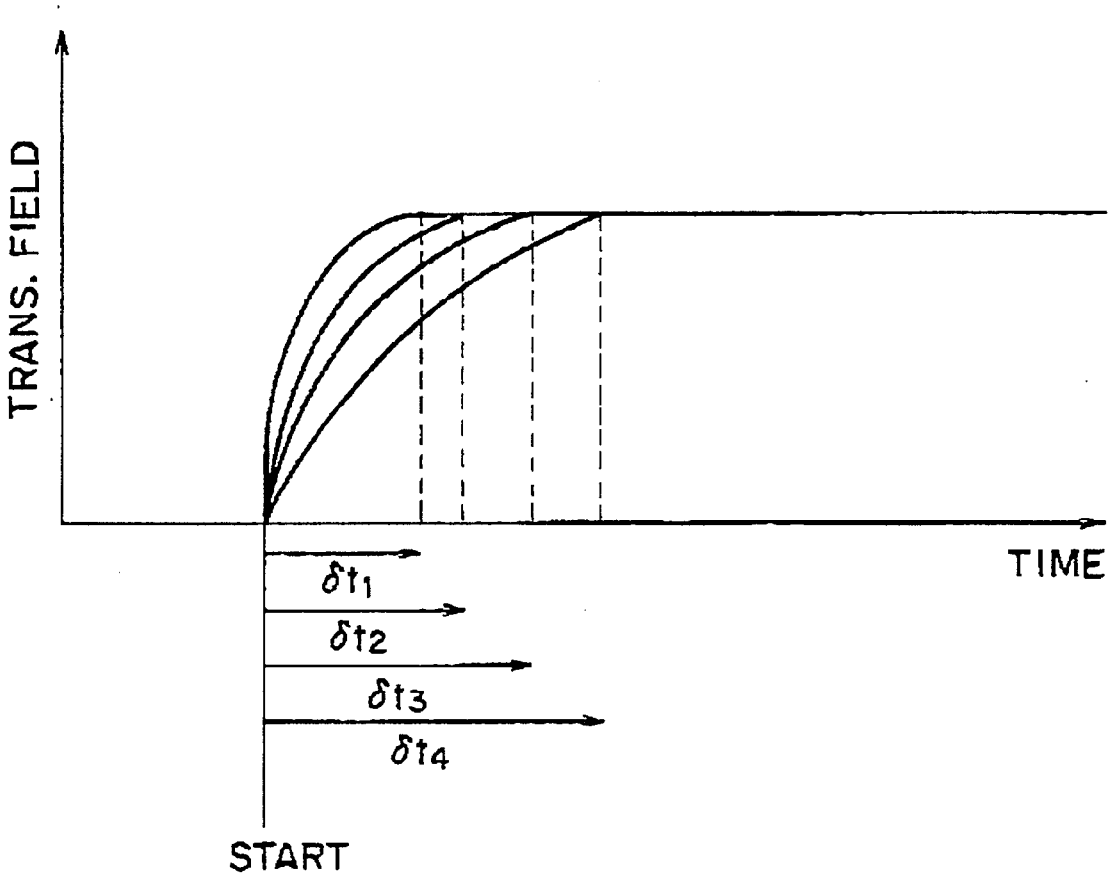
FIG. 8 is an illustration of the stage of the rising of the transfer electric field when a conventional superimposing transfer is executed.

Referring to FIG. 6, a description will be made as to a third embodiment wherein the output of the transfer charger is controlled.

In the case where the rising current is increased as in the control signal A shown in FIG. 2, the portion where the current (at the leading end of the recording material) is increased is charged up, by which upon the superimposing transfer the rise time δt4 for the final color is not substantially reduced. The drawback has-been stated in the description of the second embodiment.

In this embodiment, in order to correct this, the start timing of the control signal is deviated for the respective color transfers. FIG. 6 shows control signals upon a four color superimposing transfer. The control signal are such that it corresponds to 15 μA for the rising 8 msec, 10 μA thereafter, and the start of the power supply is such that the same timing for the first and second colors, 8 msec earlier than in the second color for the third color, and 8 msec earlier than in the third color for the fourth color. By doing so, in the third and fourth color transfers, the rising speed is equivalent to that in the first color transfer (δt). Therefore, the period δt' (the period required for rising for four colors) from the start of the transfer electric field for the fourth color in FIG. 6 to the completion of the rising which is the slowest among the four colors, was reduced to 38 msec.

In this embodiment, δt'=38 msec corresponds to 5 mm, since the process speed is 133 mm/s, so that satisfactory results can be provided in the range of 8.0 mm of the leading blank.

In any of the above-described embodiments, the output of the transfer charger is 0 prior to the rise time current applied to the transfer charger, but such a small current that the recording material is not removed from the carrying sheets, may flow.

While the invention has been described with reference to the structure disclosed herein, it is not confined to the details set forth and this application is intended to cover such modifications or changes as may come within the purposes of the improvements or the scope of the following claims.

What is claimed is:

1. An image forming apparatus comprising:

an image bearing member for bearing an image;

a recording material carrying member for carrying the recording material to a transfer position;

transfer charging means for transferring the image from said image bearing member onto the recording material carried on the recording material carrying member at the transfer position;

a power source for supplying a voltage to said transfer charging means during an image transfer operation; and control means for changing an output of said transfer charging means from a first level to a second level prior to arrival of an image area of said image bearing member at the transfer position and after arrival of a leading edge of the recording material carried on said recording material carrying member at the transfer position, wherein the second level is higher than a third level of the output of said transfer charging means which is a level when the image area is at the transfer position, and wherein said first level is lower than the third level.

2. An apparatus according to claim 1, wherein the first level is 0 volt.

3. An apparatus according to claim 1, wherein the output is changed from the second level to the third level after the change from the first level to the second level and prior to the arrival of the image area at the transfer position.

4. An apparatus according to claim 1, wherein the second level is changeable in accordance with the number of image transfer operations onto the recording material carried on the recording material carrying member.

5. An apparatus according to claim 4, wherein the second level is increased with an increase of the number of the transfer operations carried out.

6. An apparatus according to claim 4, wherein the third level is constant irrespective of the number of the transfer operations carried out.

7. An apparatus according to claim 1, wherein a time period from arrival of a leading edge of the recording material at the transfer position to the change from the first level to the second level is changeable in accordance with the number of repeated transfer operations onto the same recording material.

8. An apparatus according to claim 7, wherein the time period is decreased with increase of the number of the transfer operations carried out.

9. An apparatus according to claim 1, further comprising attraction means for electrostatically attracting the recording material prior to transfer operation.

10. An apparatus according to claim 1, wherein said apparatus is capable of forming a full color image on the recording material.

11. An apparatus according to claim 1, wherein said transfer charging means is contactable to back side of the recording material carrying member.

12. An apparatus according to claim 1, wherein said transfer charging means is constant-current-controlled, and the output of said transfer charging means is an output when constant current control is being effected.

13. An image forming apparatus comprising:

an image bearing member for bearing an image;

a recording material carrying member for carrying a recording material to a transfer position;

transfer charging means for transferring the image from said image bearing member onto the recording material carried on the recording material carrying member at the transfer position;

a power source for supplying a voltage to said transfer charging means during an image transfer operation; and control means for changing an output of said transfer charging means from a first level to a second level prior to arrival of an image area of said image bearing member at the transfer position, wherein the second level is higher than a third level of the output of said transfer charging means which is a level when the image area is at the transfer position, and wherein the first level is lower than the third level, and wherein the second level is changeable in accordance with the number of image transfer operations onto the recording material carried on the recording material carrying member.

14. An apparatus according to claim 13, wherein the first level is a zero voltage level.

15. An apparatus according claim 13, wherein said control means changes the output from the first level to the second level when the recording material is present at the transfer position.

16. An apparatus according to claim 13, wherein the output is changed from the second level to the third level after the change from the first level to the second level and prior to the arrival of the image area at the transfer position.

17. An apparatus according to claim 16, wherein when the recording material is at the transfer position, the output is changed from the first level to the second level.

18. An apparatus according to claim 15 or 17, wherein a time period from arrival of a leading edge of the recording material at the transfer position to the change from the first level to the second level is changeable in accordance with the number of repeated transfer operations onto the same recording material.

19. An apparatus according to claim 18, wherein the time period is decreased with increase of the number.

20. An apparatus according to claim 13, wherein the second level is increased with an increase of the number of the transfer operations carried out.

21. An apparatus according to claim 13, wherein the third level is constant irrespective of the number of the transfer operations carried out.

22. An apparatus according to claim 13, further comprising attraction means for electrostatically attracting the recording material prior to transfer operation.

23. An apparatus according to claim 13, wherein said apparatus is capable of forming a full color image on the recording material.

24. An apparatus according to claim 13, wherein said transfer charging means is contactable to a back side of the recording material carrying member.

25. An apparatus according to claim 13, wherein said transfer charging means is constant-current-controlled, and the output of said transfer charging means is an output when constant current control is being effected.

26. An image forming apparatus comprising:

an image bearing member for bearing an image;

a recording material carrying member for carrying a recording material to a transfer position;

transfer charging means for transferring the image from said image bearing member onto the recording material carried on the recording material carrying member at the transfer position;

a power source for supplying a voltage to said transfer charging means during an image transfer operation; and control means for changing an output of said transfer charging means from a first level to a second level prior to arrival of an image area of said image bearing member at the transfer position and after arrival of a leading edge of the recording material carried on said recording material carrying member at the transfer position, wherein the second level is higher than a third level of the output of said transfer charging means which is a level when the image area is at the transfer position, and wherein the first level is lower than the third level, and wherein a time period from arrival of a leading edge of the recording material at the transfer position to the change from the first level to the second level is changeable in accordance with the number of repeated transfer operations onto the same recording material.

27. An apparatus according to claim 26, wherein the first level is a zero voltage level.

28. An apparatus according to claim 26, wherein said control means changes the output from the first level to the second level, when the recording material is present at the transfer position.

29. An apparatus according to claim 26, wherein the output is changed from the second level to the third level after the change from the first level to the second level and prior to the arrival of the image area at the transfer position.

30. An apparatus according to claim 26, wherein the time period is decreased with an increase of the number of the transfer operations carried out.

31. An apparatus according to claim 26, further comprising attraction means for electrostatically attracting the recording material prior to transfer operation.

32. An apparatus according to claim 26, wherein said apparatus is capable of forming a full color image on the recording material.

33. An apparatus according to claim 26, wherein said transfer charging means is contactable to a back side of the recording material carrying member.

34. An apparatus according to claim 26, wherein said transfer charging means is constant-current-controlled, and the output of said transfer charging means is the output during the constant current control being effected.

35. An apparatus according to claim 1, 13 or 26, wherein said recording material carrying member is in the form of a drum.

* * * * *

UNITED STATES PATENT AND TRADEMARK OFFICE

CERTIFICATE OF CORRECTION

PATENT NO. : 5,598,256

DATED : January 28, 1997

INVENTOR(S) : Yoichi KIMURA, et al.

It is certified that error appears in the above-indentified patent and that said Letters Patent is hereby corrected as shown below:

COLUMN 1:

Line 7, "printer,for" should read --printer, for--;
Line 16, "Carried" should read --carried--; and
Line 44, "the $\delta$t" should read --($\delta$t)--.

COLUMN 2:

Line 49, "The" should read --the--;
Line 55, "unknown," should read --(unshown)--;
Line 56, "an" should read --a--, and "unshown," should read --(unshown),--; and
Line 65, "an" should be deleted.

UNITED STATES PATENT AND TRADEMARK OFFICE

CERTIFICATE OF CORRECTION

PATENT NO. : 5,598,256

DATED : January 28, 1997

INVENTOR(S) : Yoichi KIMURA, et al.

It is certified that error appears in the above-indentified patent and that said Letters Patent is hereby corrected as shown below:

COLUMN 3:

Line 4, "an" should read --and--;
Line 5, "device" should read --devices--;
Line 33, "separated" should read --separate--;
Line 47, "rotation" should read --rotation,--;
Line 48, "5FI" should read --5f--; and
Line 63, "are" should read --is--.

COLUMN 4:

Line 23, "discribed" should read --described--;
Line 27, "the" (first occurrence) should be deleted;
Line 36, "it or" should read --or it--; and
Line 49, "hat" should read --that--.

UNITED STATES PATENT AND TRADEMARK OFFICE

CERTIFICATE OF CORRECTION

PATENT NO. : 5,598,256

DATED : January 28, 1997

INVENTOR(S) : Yoichi KIMURA, et al.

It is certified that error appears in the above-indentified patent and that said Letters Patent is hereby corrected as shown below:

COLUMN 5:

Line 6, "an" should read --and--;
Line 8, "charges," should read --charger,--;
Line 13, "ms" should read --msec--;
Line 61, "4" should read --four--;
Line 63, "4" should read --four--; and
Line 65, "Is" should read --is--.

COLUMN 6:

Line 24, "2-4th color," should read --second to fourth colors--;
Line 25, "than the other." should read --than for the other colors.--;
Line 39, "has-been" should read --has been--;
Line 46, "are" should read --is--; and
Line 59, "blank." should read --blank edge.--.

UNITED STATES PATENT AND TRADEMARK OFFICE

CERTIFICATE OF CORRECTION

PATENT NO. : 5,598,256 Page 4 of 4

DATED : January 28, 1997

INVENTOR(S) : Yoichi KIMURA, et al.

It is certified that error appears in the above-indentified patent and that said Letters Patent is hereby corrected as shown below:

COLUMN 7:

Line 48, "with" should read --with an--; and
Line 52, "to transfer" should read --to the transfer--.

COLUMN 8:

Line 39, "number." should read --number of transfer operations carried out--.

Signed and Sealed this

Eighth Day of July, 1997

Bruce Lehman

*Attest:*

BRUCE LEHMAN

*Attesting Officer*

*Commissioner of Patents and Trademarks*